US006409293B1

(12) United States Patent
Chang

(10) Patent No.: US 6,409,293 B1
(45) Date of Patent: Jun. 25, 2002

(54) CABINET AND DRAWER ASSEMBLY STRUCTURE

(76) Inventor: Ching-Chang Chang, No. 14, Tzu-Chiang Rd., Yeh-Pu Hsiang, Ping-Tung Hsien (TW)

( * ) Notice: Subject to any disclaimer, the term of this patent is extended or adjusted under 35 U.S.C. 154(b) by 0 days.

(21) Appl. No.: 09/910,727

(22) Filed: Jul. 24, 2001

(51) Int. Cl.[7] ..... A47B 47/00; A47B 88/00

(52) U.S. Cl. ..... 312/257.1; 312/263; 312/265.5; 312/348.1

(58) Field of Search ..... 312/257.1, 263, 312/265.5, 902, 350, 351, 108, 111, 330.1, 348.1, 348.2

(56) References Cited

U.S. PATENT DOCUMENTS 3,856,374 A * 12/1974 Christen ..... 312/263
4,288,132 A * 9/1981 Znamirowski et al. ... 312/265.5
5,645,332 A * 7/1997 Snoke et al. ..... 312/257.1
5,713,649 A * 2/1998 Swift ..... 312/348.1 X
5,823,650 A * 10/1998 Lin ..... 312/348.1
6,099,095 A * 8/2000 Irace ..... 312/257.1

* cited by examiner

*Primary Examiner*—James O. Hansen
(74) *Attorney, Agent, or Firm*—Birch, Stewart, Kolasch & Birch, LLP

(57) ABSTRACT

A cabinet and drawer assembly structure mainly utilizes ball screw rods to fasten two rear panels in a juxtaposed fashion and to fasten two opposing side panels to the rear panels. The side panels have square channels which have aperture and troughs to allow wedge legs of a transverse beam to wedge in. The rear panels and side panels have jut edges extended from the top ends thereof to couple with wedge slots formed on the peripheral rims of an upper panel, thus coupling and fastening of the peripheral panels and the upper panel and lower panel and front panel may be accomplished rapidly to complete the cabinet assembly. The inner sides of the side panels may have slide roller channels mounted thereon to support a drawer assemble.

2 Claims, 11 Drawing Sheets

CABINET AND DRAWER ASSEMBLY STRUCTURE

BACKGROUND OF THE INVENTION

The present invention relates to a rapid fastening assembly structure and particularly an assembly structure adaptable for use in drawers and any types of cabinets such as table cabinets, partition cabinets, wine cabinets and the like that is convenient to disassemble, occupies small space, and is easy to transport for onsite assembling and fastening.

Most commonly used drawers and cabinets now available on the market are assembled and fixedly fastened by soldering, then are delivered to users' sites. Various problems could happen during transportation, such as:

1. The assembled and finished drawers and cabinets take too much space. Transportation from the factory to users' sites requires too much time and costs. Installations and operations also are cumbersome.
2. Assembly of the drawers and cabinets requires special cares and efforts on the total structure (as the whole set of the cabinet is fixedly assembled and fastened). A small negligence or accidence during transportation could damage the drawers or the cabinets, or even destroy the whole structure of the cabinets.

SUMMARY OF THE INVENTION

It is therefore the primary object of the present invention to provide a rapid fastening assembly structure adaptable for use in drawers and cabinets that is convenient to disassemble, occupies small space, and is easy to transport for onsite assembling and fastening.

To attain the foregoing object, the cabinet and drawer assembly structure according to the invention includes two juxtaposed rear panels coupling with two opposing and symmetrical side panels. The two rear panels have respectively a square channel formed at the fastening end and may be fastened by a ball screw rod. The side panels have respectively square channels with a trough located at the top end and bottom end thereof to allow two ends of a transverse beam to wedge in. The rear panels and side panels further have respectively a jut edge extended from the top ends thereof to engage with a wedge trough formed at the peripheral rim of a top panel. There are also a bottom panel and a front panel to engage with the peripheral panels to complete the cabinet assembly. When there is a desire to couple a drawer in the cabinet, install slide roller channels on the inner side of the two side panels without soldering. Thus destruction of the structure resulting from the soldering may be avoided. The structure of the invention does not take much space and may be transported easily to users' sites for assembly and fastening. Through fastening the panels by the ball screw rod and transverse beam, various cabinets can be made. The drawer plates may be assembled through rods and slide channels, then couple with one another. All the drawer and cabinet elements may be stacked for transportation to users' sites, then assembled and fastened by means of screws. The storing and transportation space and costs thus may be greatly reduced. Hence the invention provides advantages not feasible to the conventional cabinets and drawers.

The foregoing, as well as additional objects, features and advantages of the invention will be more readily apparent from the following detailed description, which proceeds with reference to the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
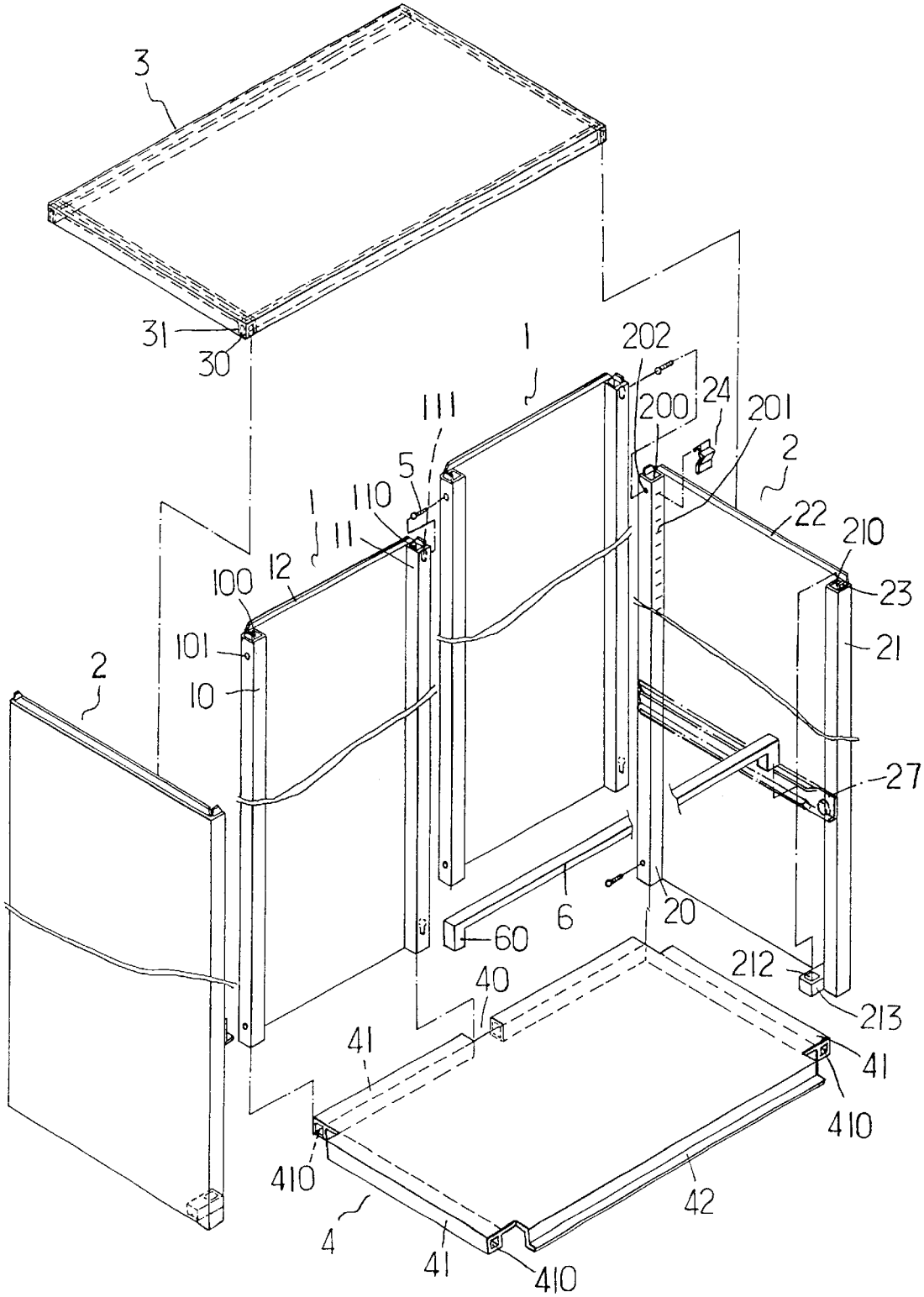
FIG. 1 is an exploded view of a cabinet of the invention.
Figure 2:
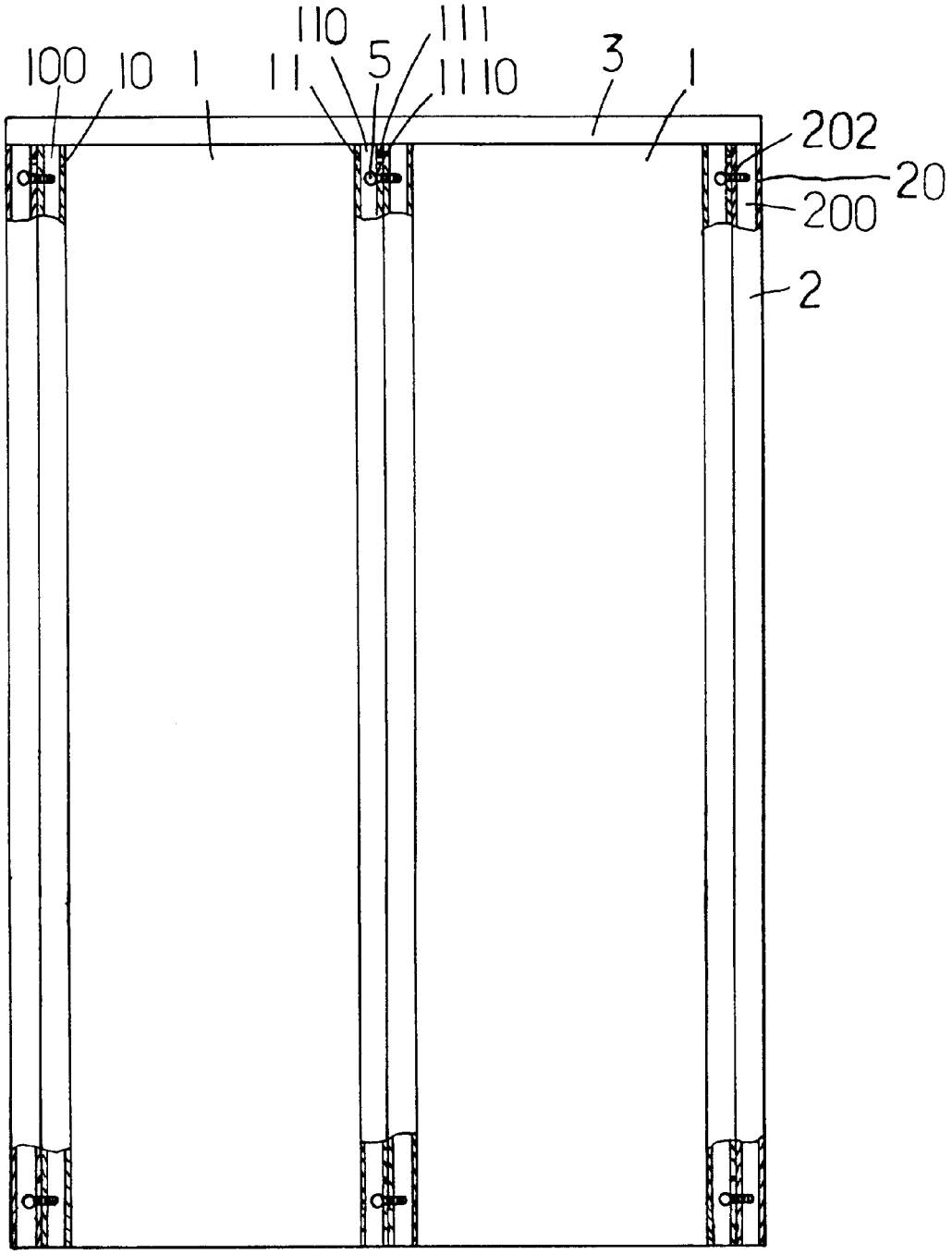
FIG. 2 is a schematic view of a cabinet of the invention in assembly (rear panels screwed to side panels).

Referring to FIGS. 1 and 2, the cabinet assembly according to the present invention mainly includes two identical rear panels 1 juxtaposed side by side, two side panels 2 opposing to each other, an upper panel 3, and a lower panel 4. They may be assembled and fastened to form various cabinets desired such as table cabinets, partition cabinets, wide cabinets and the like (referring to FIGS. 2 and 3). On the inner side of the two side panels 2, slide roller channels 27 may mounted thereon to couple with a drawer assembly 7.

Figure 5:
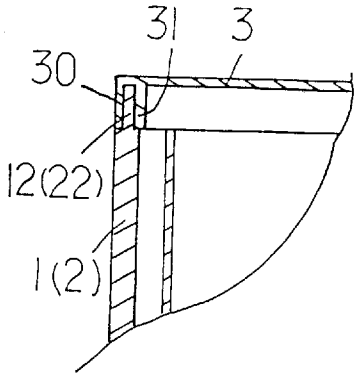
FIG. 5 is a fragmentary sectional view of a rear panel, side panel and upper panel at an assembled state.

The two rear panels 1 are identically shaped and formed. Each rear panel has two square channels 10 and 11 located at two sides which form respectively a trough 100 and 110 therein. The left hand side channel 10 has an upper end and a lower end each has a screw bore 101 formed therein. The right hand side channel 11 has an upper end and a lower end each has a key hole 111 formed therein. The key hole 111 has a longitudinal slot 1110 for receiving and engaging with a ball screw rod 5 (shown in FIG. 4) to fasten the two juxtaposed rear panels 1. The two side panels 2 also have respectively square channels 20 and 21 at two sides which have a trough 200 and 210 formed therein. The channel 20 on the left hand side also have screw bores 202 formed at the upper end and lower end for fastening to the rear panel 1. The top end of the rear panel 1 has a jut edge 12 to wedge in a wedge slot 30 formed on the peripheral rims of the upper panel 3 (shown in FIG. 5). The lower panel 4 has a notch 40 formed on a rear rim to match and engage with the bottom end of the coupled left and right channel 10 and 11 of the rear panels 1. Thus form the coupling and fastening of the panels.

Figure 6:
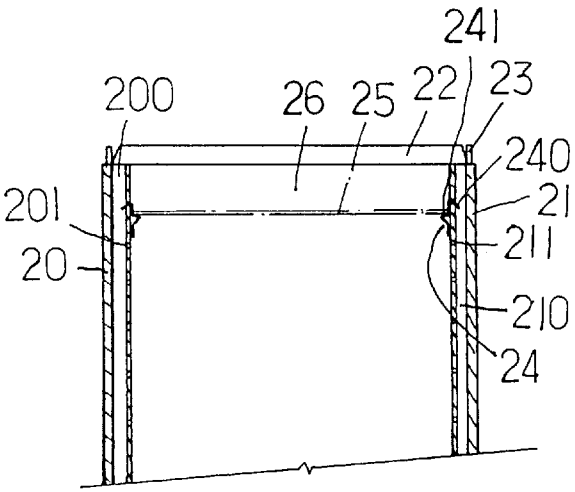
FIG. 6 is a fragmentary schematic view of a side panel coupling with a partition.
Figure 7:
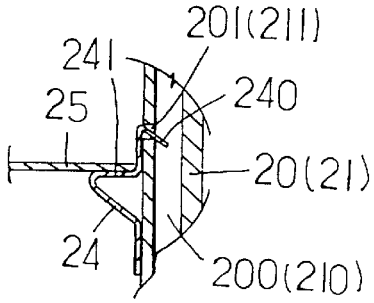
FIG. 7 is a fragmentary sectional view of a side panel coupling with a bracket.

As mentioned before, the two side panels 2 have respectively square channels 20 and 21 at two sides which have a trough 200 and 210 formed therein. The right channel 21 has an anchor block 213 extended from the bottom end thereof. The anchor block 213 has an aperture 212 formed thereon. The aperture 212 of the anchor block 213 and troughs 200 and 210 of the left and right square channel 20 and 21 allow wedge legs 60 of a transverse beam 6 to wedge in. The top ends of the side panels 2 have jut edges 22 and 23 to wedge in a wedge slot 30 formed on the peripheral rims of the upper panel 3 (shown in FIG. 5). The left square channel 20 also have screw bores 202 formed at the upper end and lower end for fastening to the square channels 10 and 11 of the rear panel 1 through the ball screw rod 5 in the key hole 111 at the slot 1110. On the inner sides of the left and right square channel 20 and 21 facing each other, there are equally spaced wedge notches 201 and 211 for receiving snap fingers 240 of brackets 24. The bracket 24 has a nose section 241 to support a partition 25 (shown in FIGS. 6 and 7) for forming a holding space 26.

Figure 8:
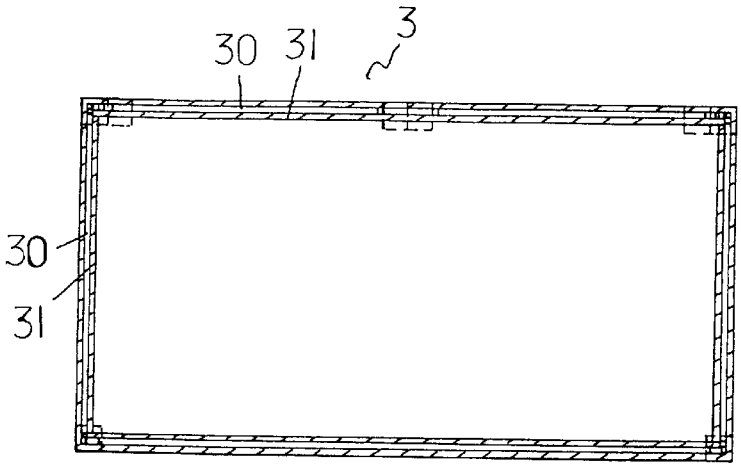
FIG. 8 is a top sectional view of an upper panel.

The upper panel 3 (shown in FIGS. 5 and 8) has a wedge slot 30 formed on the peripheral rims extending downwards to allow the jut edges 12, 22, and 23 formed at the top end of the rear panels 1 and side panels 2 to wedge in and couple securely.

Figure 9:
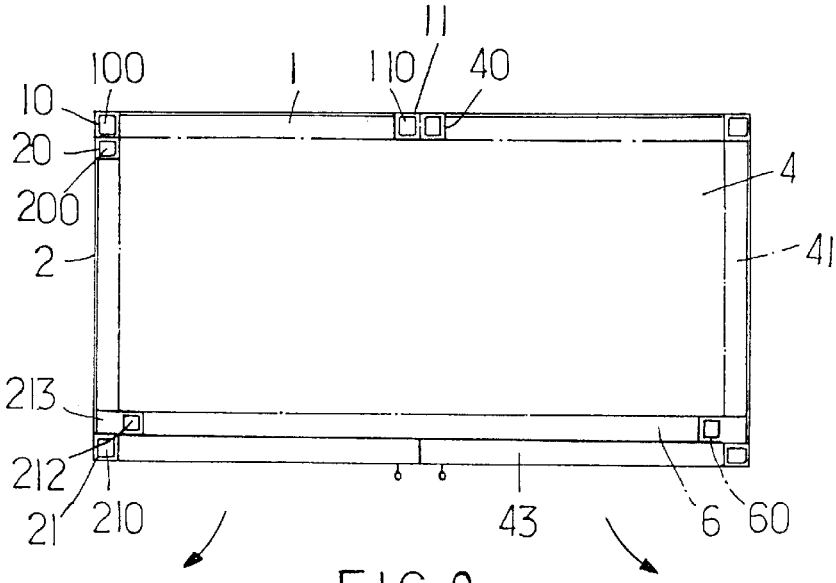
FIG. 9 is a bottom view of an assembled cabinet of the invention.

The lower panel 4 (shown in FIGS. 3 and 9) has left, right and rear sides bent respectively to form a square channel 41 with a trough 410 inside. The lower panel 4 has notches 40 formed at two ends of two sides and at the center of the rear side to wedge and couple with the rear panel 1 and side panels 2. The front edge of the lower panel 4 is extended forwards to form a jutting ledge 42 to match and contact a front panel 43.

Figure 3:
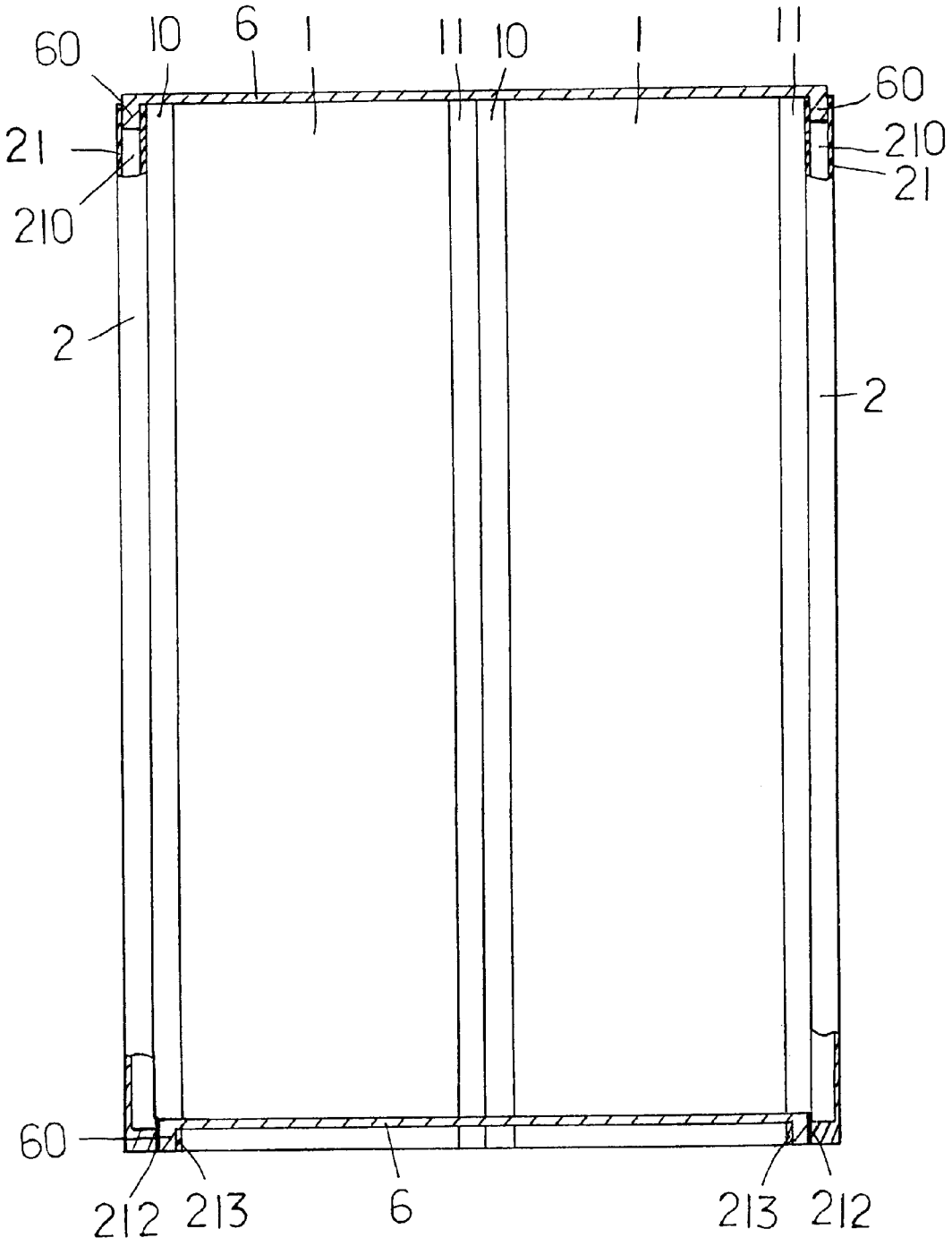
FIG. 3 is another schematic view of a cabinet of the invention in assembly (side panels fastened by transverse beams at the top end and bottom end).
Figure 4:
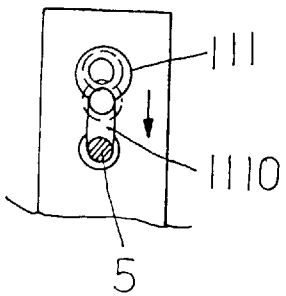
FIG. 4 is a schematic view of a ball screw rod at a fastening state.

The elements set forth above may be stacked and transported to users' sites. Then juxtapose and assemble the two rear panels 1, fasten the two side panels 2 and upper panel 3 and lower panel 4 through the ball screw rods 5 (as shown in FIGS. 2, 3 and 4), and wedge and fasten respectively the upper end and lower end of the front side and the rear side of the top section with the transverse beam 6, then fasten to the upper panel 3 and lower panel 4 to complete the assembly of the cabinet.

Figure 10:
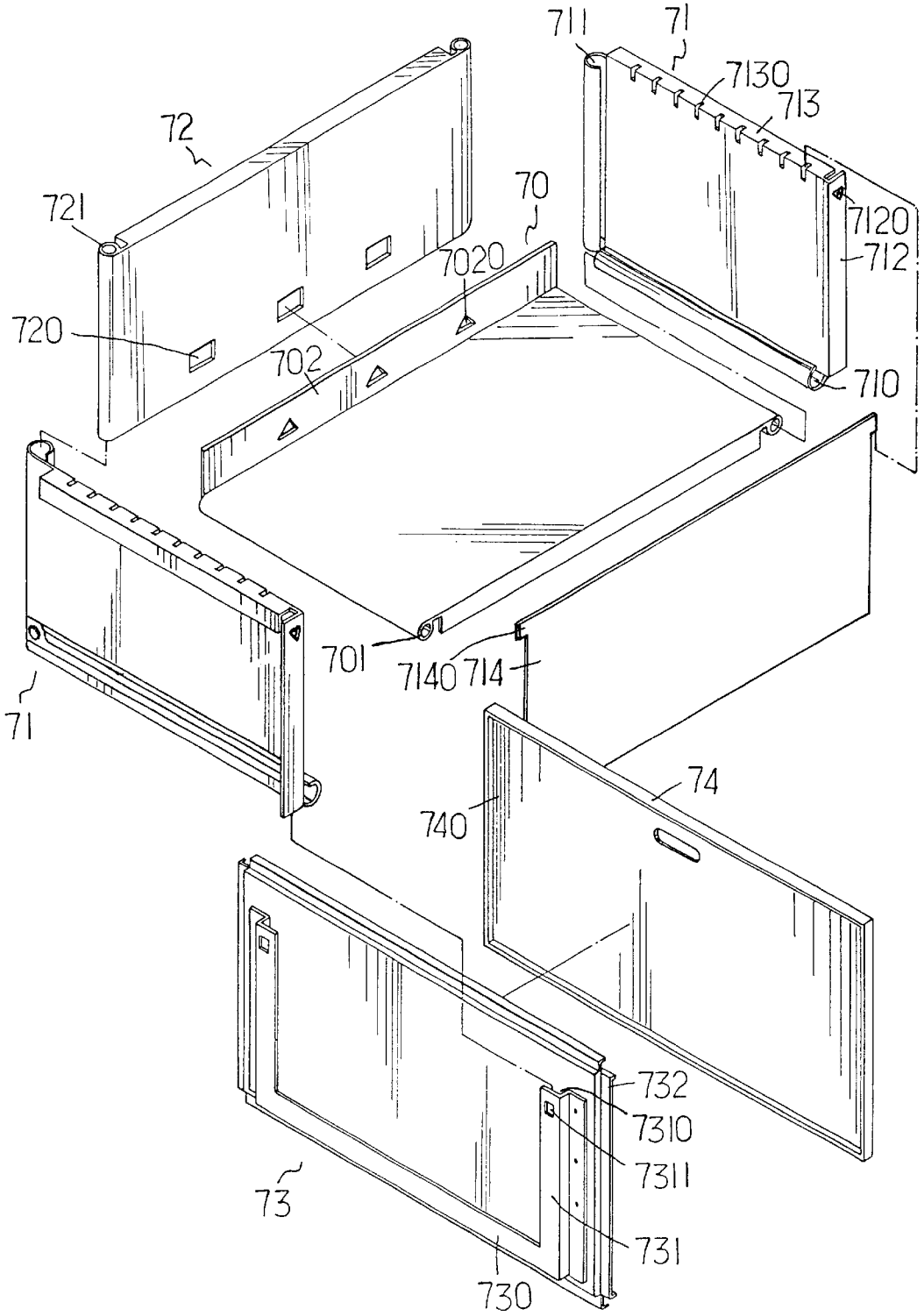
FIG. 10 is an exploded view of a drawer of the invention.

The drawer assembly 7 consists of a bottom plate 70, two opposing side plates 71, a rear plate 72, a front plate 73 and a coupling frame 74 (shown in FIG. 10).

Figure 11:
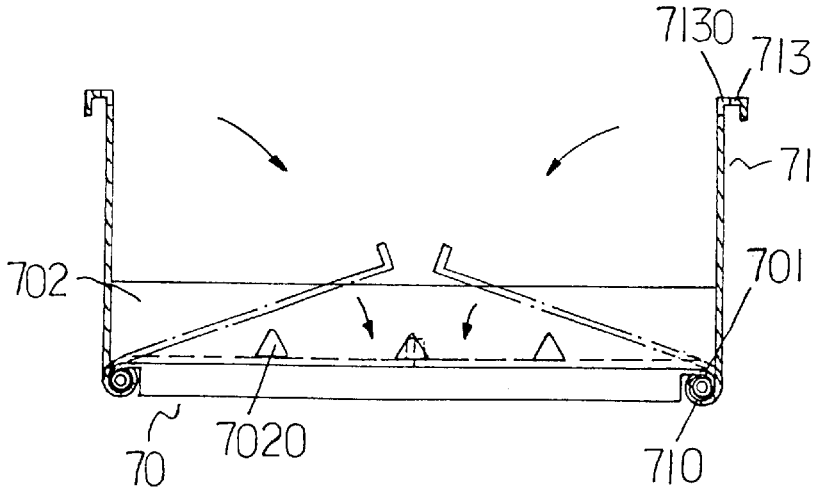
FIG. 11 is a schematic view of a bottom plate and two side plates at a folding state according to FIG. 10.
Figure 12:
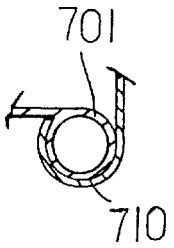
FIG. 12 is a fragmentary schematic view of a rod of a bottom plate engaging with a slide channel of a side plate according to FIG. 10.
Figure 13:
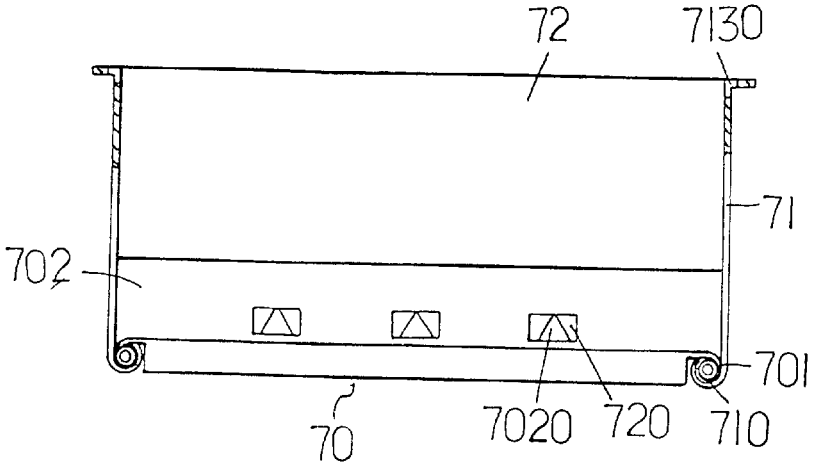
FIG. 13 is a front view of a bottom plate, rear plate and two side plates at an assembled state according to FIG. 10.
Figure 14:
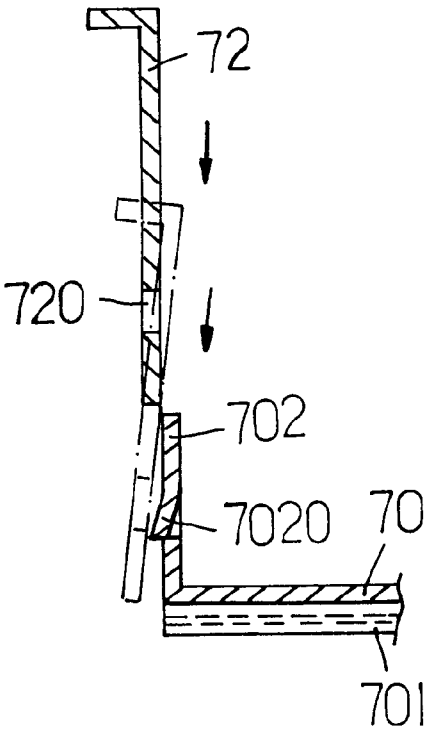
FIG. 14 is a fragmentary schematic view of a rear plate engaging with a bottom plate according to FIG. 10.
Figure 16:
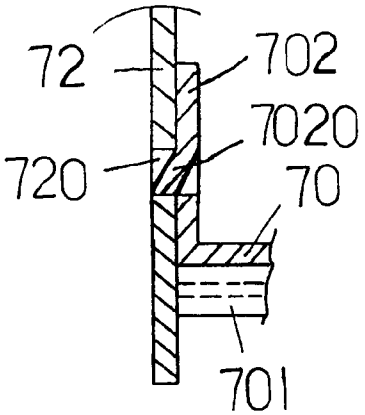
FIG. 16 is a fragmentary enlarged view of a wedge tongue of the bottom plate coupling with a square opening of the rear plate according to FIG. 15.
Figure 15:
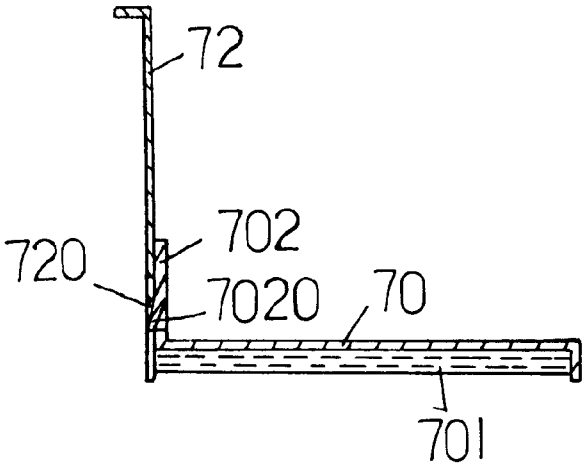
FIG. 15 is a fragmentary side view of wedge coupling shown in FIG.14.

The bottom plate 70 has two rods 701 located below two sides thereof to couple with a slide channel 710 extended from an inner side of the bottom of the side plates 71. The side plates 71 may turn about the rod 701 and rest on the bottom plate 70 for folding (shown in FIGS. 11 and 12). The bottom plate 70 has a rear edge extended upwards to form a jutting flange 702 which has wedge tongues 7020 extending outwards formed by punching to engage with square openings 720 formed on the rear plate 72 (shown in FIGS. 13, 14, 15 and 16).

Figure 17:
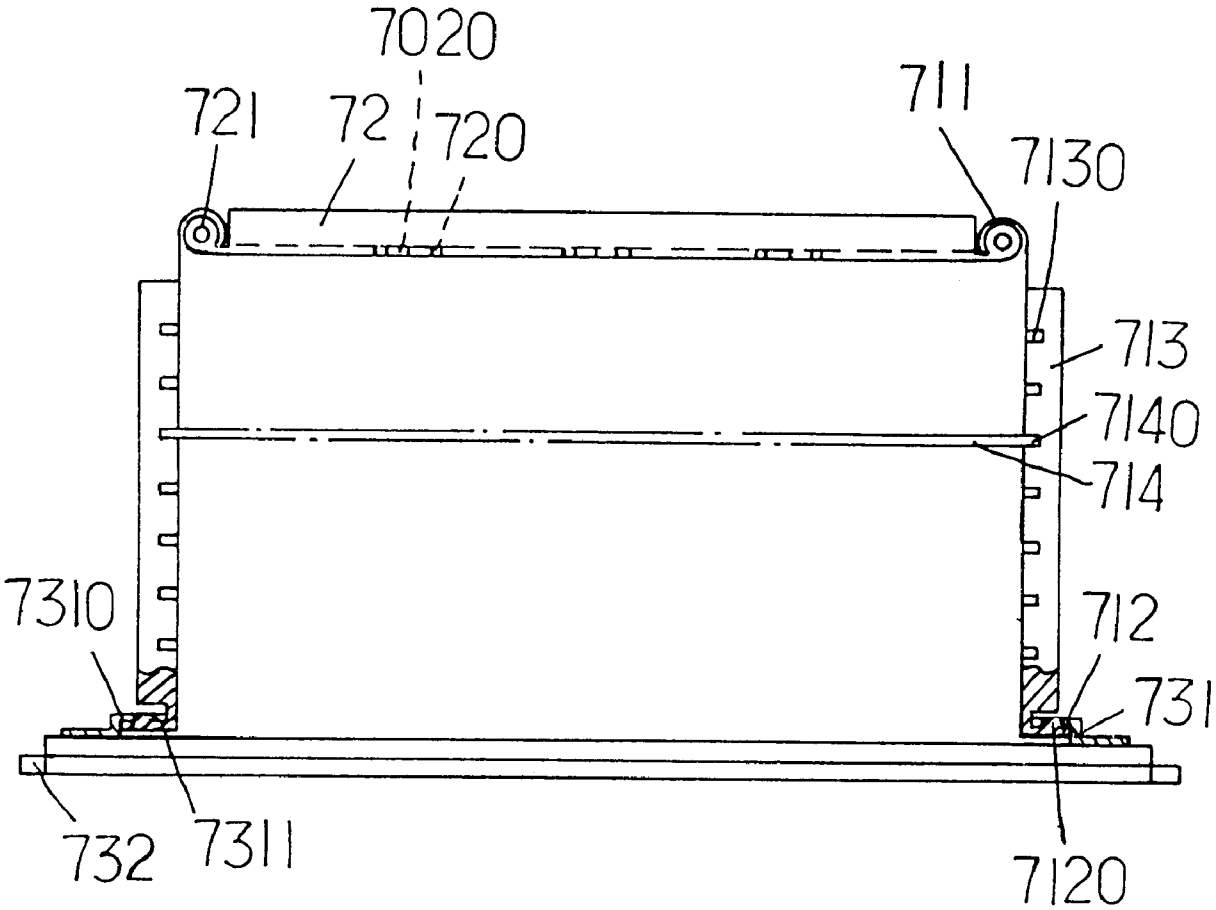
FIG. 17 is a top view of the assembly according to FIG. 10.
Figure 18:
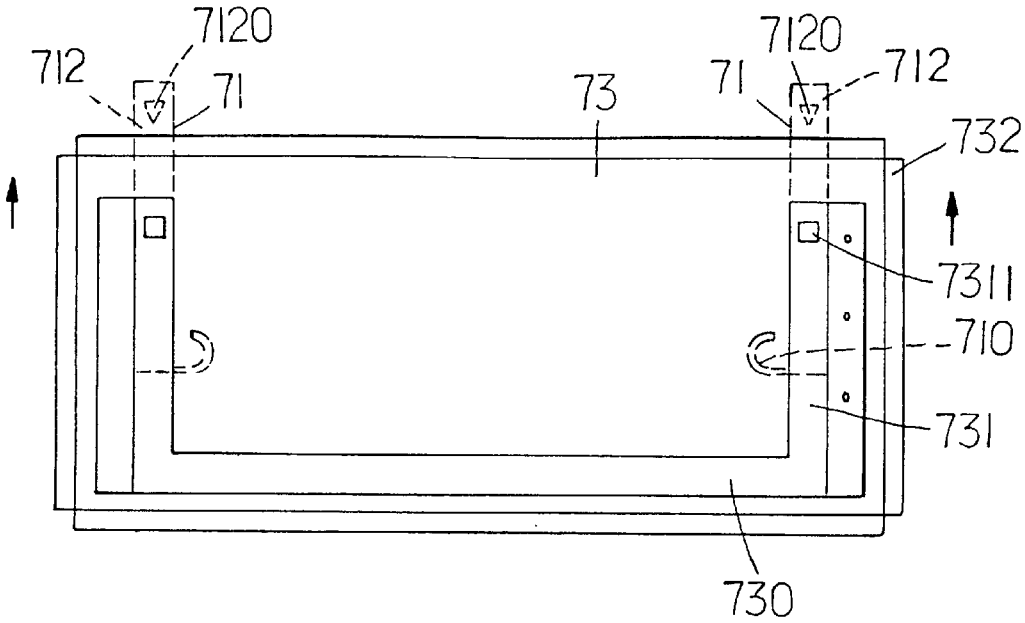
FIG. 18 is a schematic view of two side plates wedging in a front plate according to FIG. 10.
Figure 19:
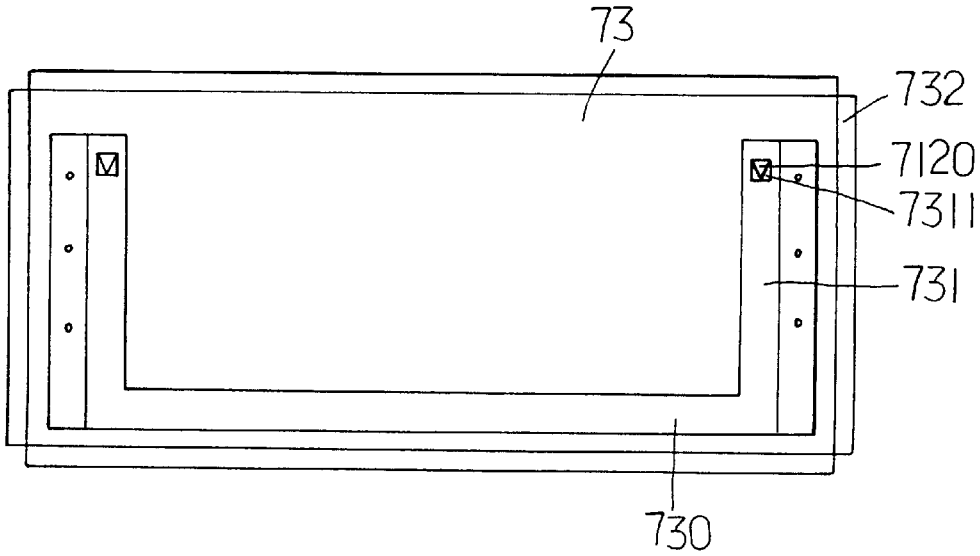
FIG. 19 is a schematic view of two side plates wedging in a front plate according to FIG. 18.

The side plate 71 (shown in FIG. 17) has slide channels 710 and 711 formed respectively on the bottom side and left hand side thereof for slidably engaging with the rods 701 and 721 located on side edges of the bottom plate 70 and the rear plate 72. The right hand side of the side plate 71 forms a coupling plate 712 extending outwards which has a wedge lug 7120 formed proximately to the top end by punching. The front plate 73 has a U-shaped frame 730 attached thereon with two troughs 7310 formed at two sides for receiving the coupling plates 712. The frame 730 has a plank 731 bordering the trough 7310 and having a square wedge aperture 7311 matching and engaging with wedge lug 7120 (shown in FIGS. 18 and 19). The top end of the side plates 71 has an extended ledge 713 which has a plurality of anchor slots 7130 for holding the latch lugs 7140 located at two sides of the top end of separators 714.

The rear plate 72 has square openings 720 proximate the bottom to engage with the wedge tongues 7020 of the jutting flange 702 of the bottom plate 70. The rear plate further has two rods 721 located at two sides thereof to couple with the slide channels 711 located on the left side of the side plates 71.

Figure 22:
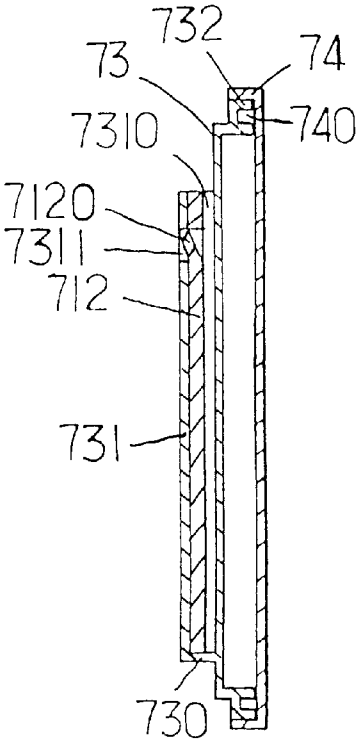
FIG. 22 is a schematic sectional view of two side plates, front plate and coupling channel at a coupling state according to FIG. 10.
Figure 21:
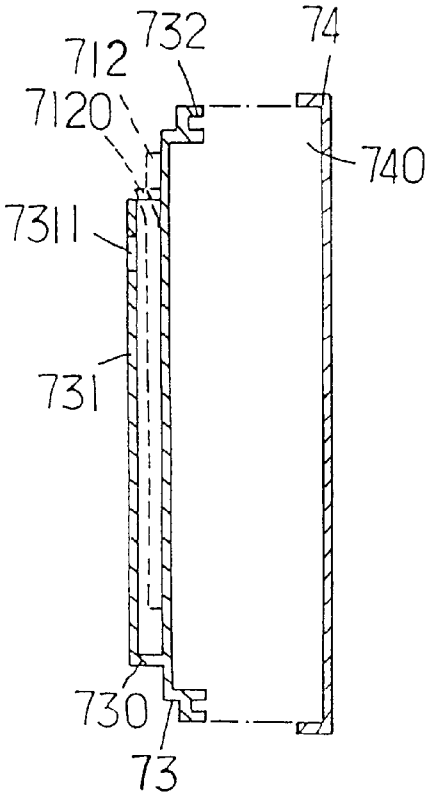
FIG. 21 is another schematic side view of the wedging relationship shown in FIG. 18.
Figure 20:
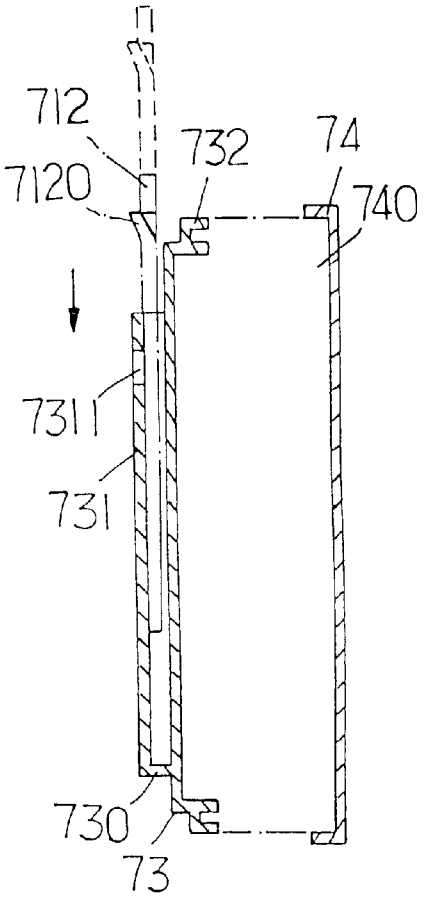
FIG. 20 is a schematic side view of the wedging relationship shown in FIG. 18.

The front plate 73 has a U-shaped frame 730 attached to the inner side with two planks 731 located at two sides extending upwards to form troughs 7310 therebelow for receiving the coupling plates 712 of the side plates 71. The coupling plate 712 has a wedge lug 7120 located at an upper end to engage with the matching square wedge aperture 7311 formed on the plank 731 (shown in FIGS. 20, 21 and 22). Furthermore, the front plate 73 has a ⊓shaped wedge plate 732 extended from two sides thereof to couple with indented recesses 740 formed on the inner rim of the coupling frame 74 (shown in FIG. 22).

The coupling frame 74 has indented recesses 740 formed on the inner rim thereof to couple with the ⊓shaped wedge plate 732 located on the front panel 73.

For assembly, couple the two side plates 71 with the bottom plate 70 by sliding the rods 701 into the troughs 710, then turning the side plates 71 inwards and resting the side plates 71 flatly on the bottom plate 70, then stack the rear plate 72, front plate 73 and coupling frame 74 thereon. Deliver the elements to users' sites. Turn the two opposing side plates 71 to the positions desired. Wedge the rods 721 at two sides of the rear plate 72 into the slide channels 711 of the left hand side of the side plates 71, and engage the square opening 720 of the rear plate 72 with the wedge tongue 7020 of the bottom plate 70, then wedge the coupling plates 712 of the side plates 71 into the troughs 7310 at two sides of the U-shaped frame 730 attached to the inner side of the front plate 73 with the coupling frame 74 coupled thereon to complete the drawer assembly.

For disassembly of the cabinets or drawers, first, disassemble the front plate 73 and rear plate 72 from the side plates 71, turn the two opposing side plates 71 inwards above the bottom plate 70. Then remove the upper and lower panels 3 and 4, and transverse beam 6, unfasten the ball screw rods 5 to separate the side panels 2 and rear panels 1. Stack the disassembled elements for transportation. Thus it does not take much space, and can save a lot of transportation space and costs.

The invention being thus described, it will be obvious that the same may be varied in many ways. Such variations are not to be regarded as a departure from the spirit and scope of the invention, and all such modifications as would be obvious to one skilled in the art are: intended to be included within the scope of the following claims.

What is claimed is:

1. A cabinet and drawer assembly structure comprising a cabinet assembly having two identical rear panels juxtaposed together and fastened to two side panels at two sides and an upper panel and a lower panel, and the side panels having respectively an inner side with a slide roller channel mounted thereon for supporting a drawer assembly, wherein:

the two rear panels are identically shaped and formed, each rear panel having two first square channels located at two sides thereof which form respectively a trough therein, the first channel on the left hand side of each rear panel having an upper end and a lower end each having a screw bore formed. therein, the first channel on the right hand side of each rear panel having an upper end and a lower end each having a key hole formed therein, the key holes having a longitudinal slot for receiving and engaging with a ball screw rod to fasten the two juxtaposed rear panels, the two side panels having respectively a second rear square channel and second forward square channel located at two sides thereof which have a trough formed therein; the second rear square channel of each side panel having screw bores formed at the upper end and lower ends thereof for fastening to the rear panels, each of the rear panels having a jut edge formed on the top end thereof to wedge in a wedge slot formed on the peripheral rims of the upper panel, the lower panel having a notch formed on a rear rim thereof to match and engage with the bottom ends of the coupled first inner channels of the rear panels;

the second forward channel of the side panels having an anchor block extended from the bottom ends thereof, each of the anchor blocks having an aperture formed therein, the apertures of the anchor blocks and the troughs of the second rear and forward square channels allowing wedge legs of a transverse beam to wedge in, the side panels having jut edges formed at the top ends thereof to wedge in the wedge slot formed on the peripheral rims of the upper panel, the second rear square channel of a right one of the side panels having screw bores formed at the upper ends and lower ends thereof for fastening to one of the first square channels of one of the rear panels through the ball screw rods in key holes at the slots, the left one of the side panels being attached to another one of the rear panels, the second rear and forward square channels of each side panel having an inner side facing each other with equally spaced wedge notches formed thereon facing wedge notches of both of the side panels engaging with snap fingers of a bracket, each of the brackets having a nose section to support a partition for forming a holding space;

the wedge slot formed on the peripheral rims of the upper panel extends downwardly for receiving the jut edges formed at the top end of the rear panels and side panels to be wedged in and coupled securely thereto;

the lower panel has the left, right and rear sides bent respectively to form a third square channel with a trough formed inside, the lower panel having notches formed at two ends of two sides thereof to wedge and couple with the side panels, the front edge of the lower panel being extended forwards to form a jutting ledge to match and contact a front panel; and the drawer assembly includes a bottom plate, two opposing side plates, a rear plate, a front plate and a coupling frame, wherein:

the bottom plate has two rods located below two sides thereof to couple with a slide channel extended from an inner side of the bottom of the side plates, the side plates being turnable about the rod for resting on the bottom plate for folding, the bottom plate having a rear edge extended upwards to form a jutting flange which has wedge tongues extending outwards formed by punching to engage with square openings formed on the rear plate;

the side plates each having a slide channel formed on a side thereof in addition to the slide channel formed on the bottom thereof, each of the slide channels on the sides being slidably engageable with a rod located on one of the side edges of the rear plate, a forward side of the side plates forming a coupling plate extended outwards, each of the coupling plates having a wedge lug proximate to the top end thereof formed by punching, the front plate having a U-shaped frame attached thereon with two troughs formed at two sides for receiving the coupling plates, the frame having a plank bordering the trough and having square wedge apertures matching and engaging with the wedge lugs, the side plates each having an extended ledge formed on the top end thereof which have a plurality of anchor slots for holding latch lugs located at two sides of a top end of separators;

the square openings of the rear plate are proximate the bottom thereof; and the front plate having a ⊓shaped wedge plate extended from two sides thereof to couple with indented recesses formed on the inner rim of the coupling frame;

whereby the drawer assembly is accomplished by coupling the two side plates with the bottom plate by sliding the rods into the slide channels, then turning the side plates inwards and resting the side plates flatly on the bottom plate, then stacking the rear plate, the front plate and the coupling frame, and transporting to a users' site, turning the two opposing side plates to positions desired, wedging the rods at two sides of the rear plate into the side slide channels of the side plates, and engaging the square openings of the rear plate with the wedge tongues of the bottom plate, and wedging the coupling plates of the side plates into the troughs at two sides of the U-shaped frame attached to the inner side of the front plate with the coupling frame coupled thereon; and then juxtaposing and assembling the two rear panels of the cabinet, fastening the two side panels and the upper panel and the lower panel through the ball screw rods, and wedging and fastening respectively the upper end and lower end of the front side and the rear side of the top section of the rear panels and side panels with the transverse beam, then fastening the upper panel and the lower panel to complete the cabinet and drawer assembly.

2. The cabinet and drawer assembly structure of claim 1, wherein the key holes formed in the square channels have a round aperture for receiving the ball screw rod and a longitudinal slot for securely engaging with the ball screw rod.

* * * * *